US011814882B2

(12) United States Patent
Aldersley et al.

(10) Patent No.: US 11,814,882 B2
(45) Date of Patent: Nov. 14, 2023

(54) CLOSING BAR OF A MOTOR VEHICLE BODY LOCK, MOTOR VEHICLE BODY LOCK COMPRISING SUCH A CLOSING BAR, AND CORRESPONDINGLY EQUIPPED MOTOR VEHICLE

(71) Applicant: Bayerische Motoren Werke Aktiengesellschaft, Munich (DE)

(72) Inventors: Nicholas Aldersley, Hebertshausen (DE); Michael Brandstaetter, Markt Schwaben (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 288 days.

(21) Appl. No.: 17/286,697

(22) PCT Filed: Dec. 4, 2019

(86) PCT No.: PCT/EP2019/083591
§ 371 (c)(1),
(2) Date: Apr. 19, 2021

(87) PCT Pub. No.: WO2020/156707
PCT Pub. Date: Aug. 6, 2020

(65) Prior Publication Data

US 2021/0372174 A1 Dec. 2, 2021

(30) Foreign Application Priority Data

Jan. 30, 2019 (DE) ..... 10 2019 102 393.9

(51) Int. Cl.
*E05B 85/04* (2014.01)
*E05B 77/10* (2014.01)
*E05B 77/38* (2014.01)

(52) U.S. Cl.
CPC ..... *E05B 85/045* (2013.01); *E05B 77/10* (2013.01); *E05B 77/38* (2013.01)

(58) Field of Classification Search
CPC .. E05B 85/04; E05B 85/045; E05B 2015/027; E05B 15/022; E05B 2015/023; E05B 2015/0265; E05B 15/0295
See application file for complete search history.

(56) References Cited

U.S. PATENT DOCUMENTS

2018/0320418 A1 11/2018 Berghahn
2019/0277070 A1* 9/2019 Aldersley ..... E05B 85/04
(Continued)

FOREIGN PATENT DOCUMENTS

DE 100 54 507 A1 5/2002
DE 20 2004 002 682 U1 5/2004
(Continued)

OTHER PUBLICATIONS

English translation of Chinese-language Office Action issued in Chinese Application No. 201980085544.3 dated Dec. 3, 2021 (7 pages).
(Continued)

*Primary Examiner* — Alyson M Merlino
(74) *Attorney, Agent, or Firm* — Crowell & Moring LLP

(57) ABSTRACT

A lock striker of a motor vehicle body lock includes a striker plate, crash securing means, and a striker. The striker is arranged on the striker plate. The striker has a striker section which is configured to admit a load. The striker plate has a first striker plate section which is configured to be connected to a body component. The striker plate has a second striker plate section on which the striker is arranged. The first striker plate section and the second striker plate section are elastically connected to one another. At least one aperture is situated in the second striker plate section between the first
(Continued)

striker limb and the second striker limb. The crash securing means is formed with a first end fastened to the first striker plate section and with a second end which is situated in the aperture in a contact-free manner outside a crash situation and, in a crash situation, so as to bear against the second striker plate section.

10 Claims, 1 Drawing Sheet

(56) References Cited

U.S. PATENT DOCUMENTS

| | | | | |
|---|---|---|---|---|
| 2020/0040622 | A1* | 2/2020 | Digel | E05B 85/04 |
| 2022/0065004 | A1* | 3/2022 | Aldersley | E05B 85/045 |
| 2022/0074240 | A1* | 3/2022 | Aldersley | E05B 85/045 |

FOREIGN PATENT DOCUMENTS

| | | | | |
|---|---|---|---|---|
| DE | 103 08 371 | A1 | 9/2004 | |
| DE | 10327973 | A1 * | 1/2005 | E05B 81/22 |
| DE | 102015208392 | A1 * | 11/2016 | E05B 85/045 |
| EP | 0 410 864 | A1 | 1/1991 | |
| EP | 1 113 128 | A1 | 7/2001 | |
| EP | 2290177 | A2 * | 3/2011 | E05B 85/045 |
| EP | 3 401 474 | A1 | 11/2018 | |
| FR | 2 706 938 | A1 | 12/1994 | |
| JP | 1-64569 | U | 4/1989 | |
| KR | 96-5577 | Y1 | 7/1996 | |

OTHER PUBLICATIONS

International Search Report (PCT/ISA/210) issued in PCT Application No. PCT/EP2019/083591 dated Feb. 20, 2020 with English translation (four (4) pages).

German-language Written Opinion (PCT/ISA/237) issued in PCT Application No. PCT/EP2019/0832691 dated Feb. 20, 2020 (six (6) pages).

German-language Search Report issued in German Application No. 10 2019 102 393.9 dated Dec. 12, 2019 with partial English translation (11 pages).

Norm 49 CFR 571.206—Standard No. 206 2014-12-23. Door locks and retention components. Legal Information Institute (Cornell Law School), S. 1-20. URL: http://www.law.cornell.edu/crf/text/49/571.206 (51 pages).

* cited by examiner

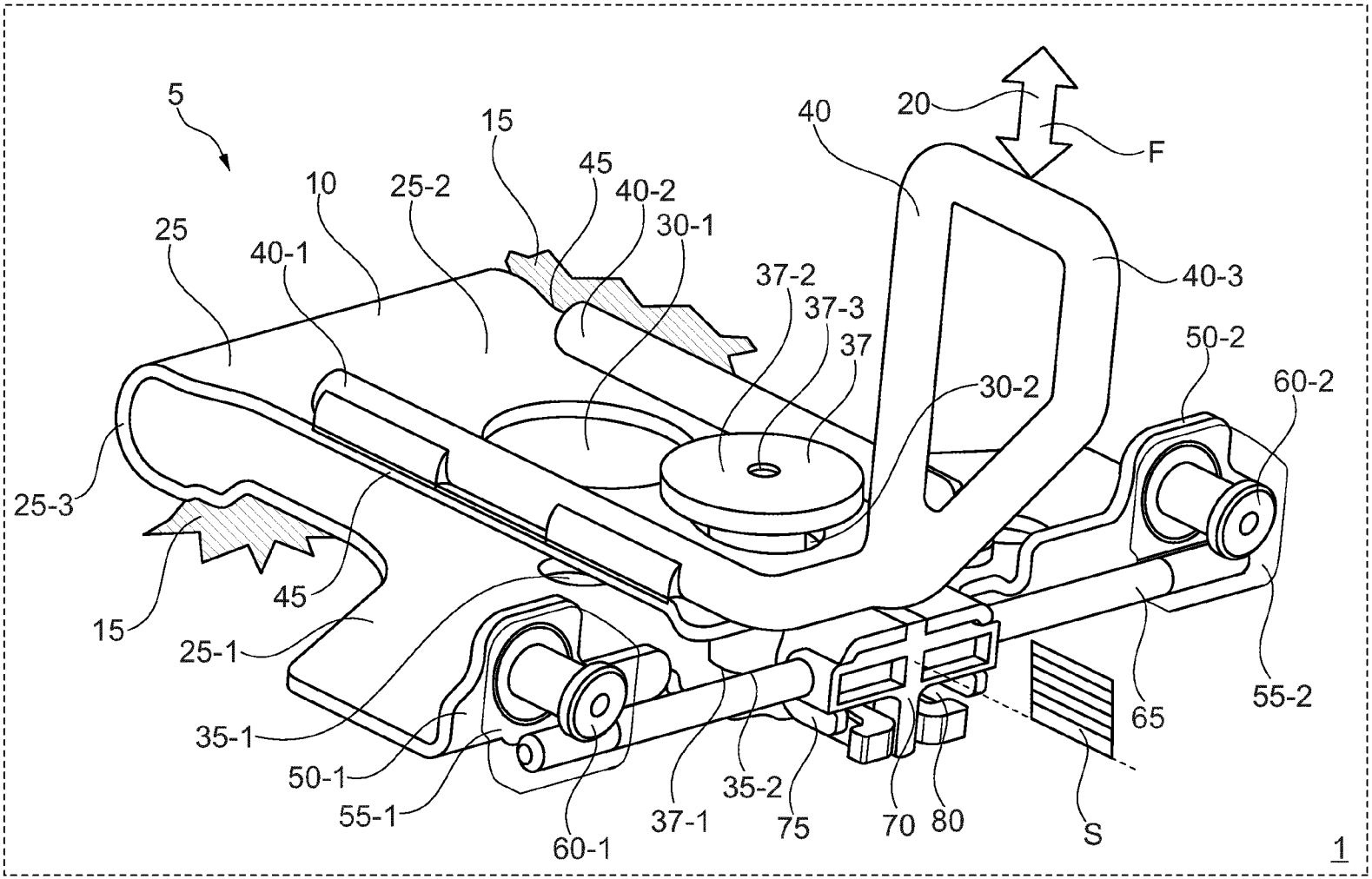
1
60-2
55-2
50-2
40-3
65
F
S
20
30-2
80
70
40
37-3
37
75
37-2
35-2
37-1
30-1
40-2
60-1
45
15
25-2
55-1
10
50-1
40-1
45
35-1
25-1
5
25
15
25-3

CLOSING BAR OF A MOTOR VEHICLE BODY LOCK, MOTOR VEHICLE BODY LOCK COMPRISING SUCH A CLOSING BAR, AND CORRESPONDINGLY EQUIPPED MOTOR VEHICLE

BACKGROUND AND SUMMARY OF THE INVENTION

The embodiments of the present invention relate to a lock striker for a motor vehicle body lock, to a motor vehicle body lock, which has a corresponding lock striker, and to a motor vehicle equipped therewith.

Lock strikers are used, in conjunction with corresponding hooks, for selectively releasing or closing in particular doors, front flaps or rear flaps. Here, on the one hand, moderate stiffness of the motor vehicle body lock in the closing direction thereof is sought, whereas, on the other hand, such moderate stiffness with respect to the relative transverse direction or vertical direction of said motor vehicle body lock is rather perceived as disadvantageous. Furthermore, to avoid disturbing noises and to compensate position tolerances of the stated parts, it is the case in a motor vehicle body locks that lock strikers are equipped with elastic elements which act as vibratory decoupling means.

The existing decoupling means however have no particular differentiation of the stiffness in the stated directions, such that, in the development of a motor vehicle body lock, there is always a conflict of aims between a limitation of a vibratory decoupling action and the direction-dependent locking function of the lock striker.

This is exacerbated by the fact that, in the event of an accident or crash, no disintegration of motor vehicle body locks may occur within certain limits, for example those stipulated within the US regulation "49 CFR 571.206—Standard No. 206; Door locks and door retention components". This requirement disadvantageously further restricts the structural space available for vibratory decoupling.

It is an object of the embodiments of the present invention to specify a lock striker of a motor vehicle body lock, by means of which the stated conflict of aims can be alleviated.

Said object is achieved by means of the inventive lock striker of a motor vehicle body lock disclosed herein. Advantageous configurations thereof are also disclosed herein.

The lock striker according to embodiments of the invention of a motor vehicle body lock has a striker arranged on a striker plate, which striker in turn has a striker section which admits a load. The expression "striker" encompasses both strikers of closed form and strikers of open form.

The load represents in particular forces and moments which can arise at the motor vehicle body lock according to the embodiments of the invention in one of the functional situations presented below, without deficient functioning thereof occurring:

In a first functional situation, defined as rest situation, the lock striker is subjected to substantially no load (that is to say when a correspondingly equipped motor vehicle body lock is open) or is subjected to only a low load (that is to say when the motor vehicle body lock, proceeding from its opened state, is closed in the intended manner or, proceeding from its closed state, is opened in the intended manner).

In a second functional situation, defined as operating position, a component which is closed by means of the lock striker, in particular a rear flap, is locked, and a correspondingly equipped motor vehicle is at a standstill or is in an intended driving state.

In a third functional situation, the motor vehicle body lock is subjected to a highly dynamic acceleration, which arises in particular during a highly dynamic closure of the motor vehicle body lock. This type of closure is caused by an improper movement, caused in particular by a person, of a component that engages into the motor vehicle body lock, such that this type of closure is sometimes also referred to as violent closure. Whereas a proper closing process involves a closing speed of up to approximately 1.4 m/s, the closing speed in the case of a violent closure is higher than this, and is higher than 1.9 m/s.

In a fourth functional situation, the motor vehicle body lock is subjected to an accident-induced highly dynamic acceleration in which the load factor is 30 g. The fourth functional situation will hereinafter be referred to as "crash situation".

According to the embodiments of the invention, the lock striker has a striker plate with a first striker plate section which is connected to a body component, in particular a hook situated on a front flap or on a rear flap, in one of the functional situations. The striker plate furthermore has a second striker plate section, on which the striker is situated. The first striker plate section and the second striker plate section are connected, preferably elastically, to one another, and—optionally—form the limbs of a U or of a V. At least one aperture is provided in the second striker plate section between the first striker limb and the second striker limb. Furthermore, the lock striker according to the embodiments of the invention comprises a crash securing means which is formed with a first end fastened to the first striker plate section and with its second end which is situated in the aperture in a contact-free manner outside a crash situation and, in a crash situation, so as to bear against the second striker plate section. The fastening of the crash securing means to the first striker plate section is realized by positive locking and/or non-positive locking or cohesion.

According to an embodiment, the first end of the crash securing means is fastened in an aperture which is situated on the first striker plate section and which is arranged in alignment with the aperture situated in the second striker plate section. For this purpose, it may be provided in particular that the aperture and at least that section of the crash securing means which is provided in said aperture for fastening purposes are formed with corresponding threads.

It is advantageously possible in this way, using simple means, to create desired direction-dependent stiffness of the motor vehicle body lock allowing for all functional situations.

In accordance with the basic principle, it is possible for the stiffness in a transition region from the first striker plate section to the second striker plate section to be attained by means of a separate additional means which connects said two striker plate sections to one another and which has a desired stiffness. The first striker plate section and the second striker plate section are however advantageously formed as a single piece, wherein the desired stiffness is attained by means of a suitable combination of the geometry of the transition region of the two striker plate sections and the material thereof, preferably a spring steel. In accordance with the basic principle, the relative arrangement of the two striker plate sections with respect to one another is likewise freely selectable. It may however advantageously be provided that the first striker plate section and the second striker plate section are oriented as mutually parallel limbs of the U.

According to an embodiment, the connecting means is formed as a T-shaped bolt, whose second end formed as a head part bears against the second striker plate section in the crash situation. An arrangement which is easy to produce and quick to install is advantageously created in this way.

According to an embodiment, it is provided that the first striker plate section has a first extreme end and, spaced apart from the latter, a second extreme end, on which extreme ends there is received a spring means. The spring means is operatively connected by way of a connecting section to the second striker plate section. In this way, a mechanical coupling of the first striker plate and of the second striker plate is advantageously created, which mechanical coupling, by way of the spring means, provides a simple facility for setting a desired stiffness of the motor vehicle body lock. Furthermore, in this way, it is advantageously possible for the lock striker according to the embodiments of the invention to be easily produced inexpensively on a mass scale but in an individualized manner: whereas the two striker plates are manufactured in similar or even identical form in large unit quantities, an individualization of the lock striker is realized by way of specific spring means. In other words, a mass-produced series of lock strikers according to the embodiments of the invention can, with a large number of similar or identical striker plates, be adapted to a particular intended use or location of use through suitable selection of spring means.

The desired mechanical action of the lock striker according to the embodiments of the invention is advantageously further improved in that the connecting section is received in a receptacle situated on the second striker plate section, wherein a damping means, particularly preferably a damping means manufactured from a plastic, in particular from a polymer, is situated on the connecting section and/or the receptacle. The above-discussed individualization or adaptation, in a mass production context, of the lock striker according to the embodiments of the invention can furthermore be further simplified or implemented through suitable selection of a damping means.

A lock striker which is particularly easy and inexpensive to produce is advantageously created if the spring means is formed in the manner of a cantilever. The above-discussed individualization or adaptation, in a mass production context, of the lock striker according to the embodiments of the invention is further simplified through suitable selection of the spring means material and the geometry thereof.

According to an embodiment, the spring means has a first end section and a second end section, wherein the first end section is fastened by a first end section receiving means and the second end section is fastened by a second end section receiving means to the first extreme end and to the second extreme end respectively. In this way, an easily configured fastening of the spring means is advantageously created, the stiffness of which can be easily further adapted by selection of a desired first end section receiving means and/or second end section receiving means. It is thus possible in particular, through suitable selection of the stated means, to achieve that the spring means is received in a play-free manner.

According to an embodiment, the striker has a first striker limb and, parallel to the latter, a second striker limb, which striker limbs are oriented symmetrically with respect to one another and with respect to a respective edge section of the second striker plate section, wherein the striker section projects orthogonally with respect to said striker limbs. Particularly straightforward installation of the striker on the second striker plate section is made possible in this way.

Particularly inexpensive installation of the lock striker according to the embodiments of the invention is made possible if at least one aperture is situated in the second striker plate section between the first striker limb and the second striker limb, which at least one aperture is arranged in alignment with respect to at least one aperture situated in the first striker plate section. In such a case, a fastening means which fastens the first striker plate to a body part, in particular a screw, can be easily guided through the aperture in the second striker plate in the direction of the first striker plate.

The object stated further above is likewise achieved by means of a motor vehicle body lock which has a lock striker of the abovementioned type. The advantages presented above apply appropriately.

The object stated further above is likewise achieved by means of a motor vehicle which has at least one motor vehicle body lock of the type disclosed above. The advantages presented above apply appropriately.

Other objects, advantages and novel features of the embodiments of the present invention will become apparent from the following detailed description of one or more preferred embodiments when considered in conjunction with the accompanying drawings.

BRIEF DESCRIPTION OF THE DRAWING

FIG. 1 is a simplified perspective view of a motor vehicle body lock 5 which is installed on a symbolically illustrated motor vehicle 1 and which has a lock striker 10.

DETAILED DESCRIPTION OF THE DRAWING

The motor vehicle body lock 10 of this exemplary embodiment is fastened by means of screws (not shown here) to a partially shown body component 15 formed as a metal sheet, for example of a front hood, and serves for the connection of a hook 20, which is illustrated merely symbolically here.

For this purpose, the motor vehicle body lock 10 has a striker plate 25 which comprises a first striker plate section 25-1, which is adjacent to the body component 15, and a second striker plate section 25-2, which is substantially parallel to said first striker plate section. The first striker plate section 25-1 and the second striker plate section 25-2 are connected to one another at a connecting section 25-3 such that, as seen in side view, they form a U-shaped configuration.

In the second striker plate section 25-2, there are situated apertures 30-1 and 30-2, which are arranged in alignment with apertures 35-1 and 35-2 respectively which are arranged in the first striker plate section 25-1. According to this exemplary embodiment, a crash securing means 37 in the form of a T-shaped bolt is arranged in the apertures 30-2 and 35-2. The first end 37-1, situated at the bottom in the FIGURE, of the crash securing means 37 is fastened in the recess 35-2. The second end 37-2, situated at the top in the FIGURE, of said crash securing means is formed as a head part and is mounted in the corresponding recess 30-2 such that, in the normal situation of the motor vehicle body lock 10 shown here, said second end does not make contact with the second striker plate section 25-2. By contrast, in the crash situation (not shown here) of the motor vehicle body lock 10, the bottom side of the second end 37-2, in head form, of the crash element 37, lies against the second striker plate section 25-2 and supports the latter. For this purpose, the outer diameter of the second end 37-2 is advantageously configured to be substantially larger than the outer diameter of the recess 30-2. For the purposes of facilitated installation and removal of the crash securing means 37, a tool engagement section 37-3, in which a tool (not shown here) can engage or act, is provided on the second end 37-2. Alternatively or in addition, at least one tool engagement section may be provided on the outer side of the second end 37-2.

The motor vehicle body lock 10 furthermore has a striker 40 with a first striker limb 40-1, a second striker limb 40-2 parallel to said first striker limb, and a striker section 40-3, on which the hook 20 engages and exerts a load F when the motor vehicle body lock 10 is closed. The first striker limb 40-1 and the second striker limb 40-2 are oriented symmetrically with respect to one another and with respect to a respective edge section 45 of the second striker plate section 25-2 (cf. plane of symmetry S). The striker section 40-3 projects substantially orthogonally with respect to said striker limbs and with respect to the second striker plate section 25-2.

The first striker plate section 25-1 comprises a first extreme end 50-1 and, spaced apart from the latter, a second extreme end 50-2, which extreme ends project in each case substantially orthogonally with respect to the former in the same direction as the striker section 40-3. A first end section receiving means 55-1 illustrated in transparent form is fastened by a fastening means 60-1 to the first extreme end 50-1 which is on the left in the FIGURE. A second end section receiving means 55-2 illustrated in transparent form is fastened by a further fastening means 60-2 to the second extreme end 50-2 which is on the right in the FIGURE. The first end section receiving means 55-1 and the second end section receiving means 55-2 support in each case one first end section of a spring means 65 which is formed in the manner of a cantilever and which is manufactured from a spring steel. The spring means 65 has, in its central region, a damping means 70 which is formed from a plastic or rubber and which is received under preload in a connecting section 75 situated on the second striker plate section 25-2; the connecting section 75 is consequently formed as a receptacle 80. Those ends of the first striker plate section 25-1 and of the second striker plate section 25-2 which are remote from the connecting section 25-3 are elastically operatively connected to one another by means of said connecting section.

A desired vibrational characteristic of the motor vehicle body lock 5 according to the embodiments of the invention can advantageously be easily generated through suitable selection of the materials and geometry of the above-described elements, in particular of the dimensions thereof.

LIST OF REFERENCE DESIGNATIONS

1 Motor vehicle
5 Motor vehicle body lock
10 Lock striker
15 Body component
20 Hook
25 Striker plate
25-1 First striker plate section
25-2 Second striker plate section
25-3 Connecting section
30-1 Aperture
30-2 Aperture
35-1 Aperture
35-2 Aperture
37 Crash securing means
37-1 First end
37-2 Second end
37-3 Tool engagement section
40 Striker
40-1 First striker limb
40-2 Second striker limb
40-3 Striker section
45 Edge section
50-1 First extreme end
50-2 Second extreme end
55-1 First end section receiving means
55-2 Second end section receiving means
60-1 Fastening means
60-2 Fastening means
65 Spring means
70 Damping means
75 Connecting section
80 Receptacle
F Load
S Plane of symmetry

What is claimed is:

1. A lock striker of a motor vehicle body lock, the lock striker comprising:
a striker plate;
a crash securing mean; and
a striker that is arranged on the striker plate, wherein
the striker has a striker section, which is configured to admit a load,
the striker plate has a first striker plate section, which is configured to be connected to a body component,
the striker plate has a second striker plate section on which the striker is arranged,
the first striker plate section and the second striker plate section are elastically connected to one another,
at least one aperture is situated in the second striker plate section, between a first striker limb of the striker and a second striker limb of the striker, and
the crash securing means is formed with a first end fastened to the first striker plate section and with a second end, which is situated in the at least one aperture so as not to contact the second striker plate section during a normal situation, the second end is configured so as to bear against the second striker plate section.

2. The lock striker according to claim 1, wherein the crash securing means is formed as a T-shaped bolt, whose second end is formed as a head part that bears against the second striker plate section in the crash situation.

3. The lock striker according to claim 2, wherein the first end of the crash securing means is fastened in an aperture, which is situated on the first striker plate section, and which is arranged in alignment with the at least one aperture situated in the second striker plate section.

4. The lock striker according to claim 3, wherein the first striker plate section has a first extreme end and, spaced apart from the first extreme end, a second extreme end, wherein on the first and second extreme ends, there is received a spring means which has a connecting section operatively connected to the second striker plate section.

5. The lock striker according to claim 4, wherein the connecting section is received in a receptacle situated on the second striker plate section, and a damping means is situated on the connecting section and/or the receptacle.

6. The lock striker according to claim 5, wherein the spring means is formed as a cantilever.

7. The lock striker according to claim 6, wherein the spring means has a first end section and a second end section, and the first end section is fastened by a first end section receiving means and the second end section is fastened by a second end section receiving means to the first extreme end and to the second extreme end respectively.

8. The lock striker according to claim 7, wherein the second striker plate section includes first and second edge sections, wherein the second striker limb is parallel to the first striker limb, wherein the first and second striker limbs are symmetrically oriented with respect to one another and with respect to the first and second edge sections, respectively, and wherein the striker section of the striker orthogonally projects with respect to said first and second striker limbs.

9. A motor vehicle body lock, having a lock striker according to claim 8.

10. A motor vehicle, having at least one motor vehicle body lock according to claim 9.

* * * * *